US008449222B2

(12) United States Patent
Westerbeek

(10) Patent No.: US 8,449,222 B2
(45) Date of Patent: May 28, 2013

(54) SYSTEM FOR AND METHOD OF INSTALLING FOUNDATION ELEMENTS IN AN UNDERWATER GROUND FORMATION

(75) Inventor: Jan Albert Westerbeek, Spijkenisse (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 13/501,459

(22) PCT Filed: Oct. 13, 2010

(86) PCT No.: PCT/EP2010/065355

§ 371 (c)(1),
(2), (4) Date: Apr. 12, 2012

(87) PCT Pub. No.: WO2011/045345

PCT Pub. Date: Apr. 21, 2011

(65) Prior Publication Data

US 2012/0201612 A1 Aug. 9, 2012

(30) Foreign Application Priority Data

Oct. 16, 2009 (EP) ..... 09173272

(51) Int. Cl.

| | |
|---|---|
| ***E02D 9/00*** | (2006.01) |
| ***E02D 11/00*** | (2006.01) |
| ***E02D 13/00*** | (2006.01) |
| ***B63B 35/40*** | (2006.01) |
| ***E21B 23/00*** | (2006.01) |
| ***E21B 23/02*** | (2006.01) |
| ***E21B 43/10*** | (2006.01) |
| ***E21B 43/00*** | (2006.01) |
| ***E03B 3/18*** | (2006.01) |

(52) U.S. Cl.
USPC ..... 405/232; 405/228; 405/249; 405/207; 166/206

(58) Field of Classification Search
USPC ..... 405/228, 249, 207, 232; 166/206
See application file for complete search history.

(56) References Cited

U.S. PATENT DOCUMENTS

| | | | | |
|---|---|---|---|---|
| 3,824,797 | A | 7/1974 | Wisotsky | |
| 4,154,307 | A * | 5/1979 | Gendron et al. | 173/21 |
| 2009/0129871 | A1 | 5/2009 | Mohr | |

FOREIGN PATENT DOCUMENTS

| | | | |
|---|---|---|---|
| DE | 1784396 | * | 8/1968 |
| DE | 1784396 | | 7/1971 |
| EP | 1482094 | | 12/2004 |
| GB | 561765 | | 6/1944 |
| GB | 2089407 | | 6/1982 |
| JP | 60159218 | | 8/1985 |
| WO | 2006117380 | | 11/2006 |
| WO | WO 2006117380 A1 | * | 11/2006 |

OTHER PUBLICATIONS

International Search Report, mailed Feb. 14, 2011 in connection with PCT/EP2010/065355.
Machine translation of JP 60159218 (abstract).
Machine translation of DE 1784396.

* cited by examiner

*Primary Examiner* — Thomas Beach
*Assistant Examiner* — Edwin Toledo-Duran
(74) *Attorney, Agent, or Firm* — De Vries & Metman

(57) ABSTRACT

The invention relates to a system for installing tubular foundation elements having open ends, in particular (mono)piles, in an underwater ground formation, comprising an hydraulic driver, an anvil, and an adaptor for transmitting energy from the anvil to the toe of the foundation element, which adaptor fits inside the tubular foundation element.

17 Claims, 1 Drawing Sheet

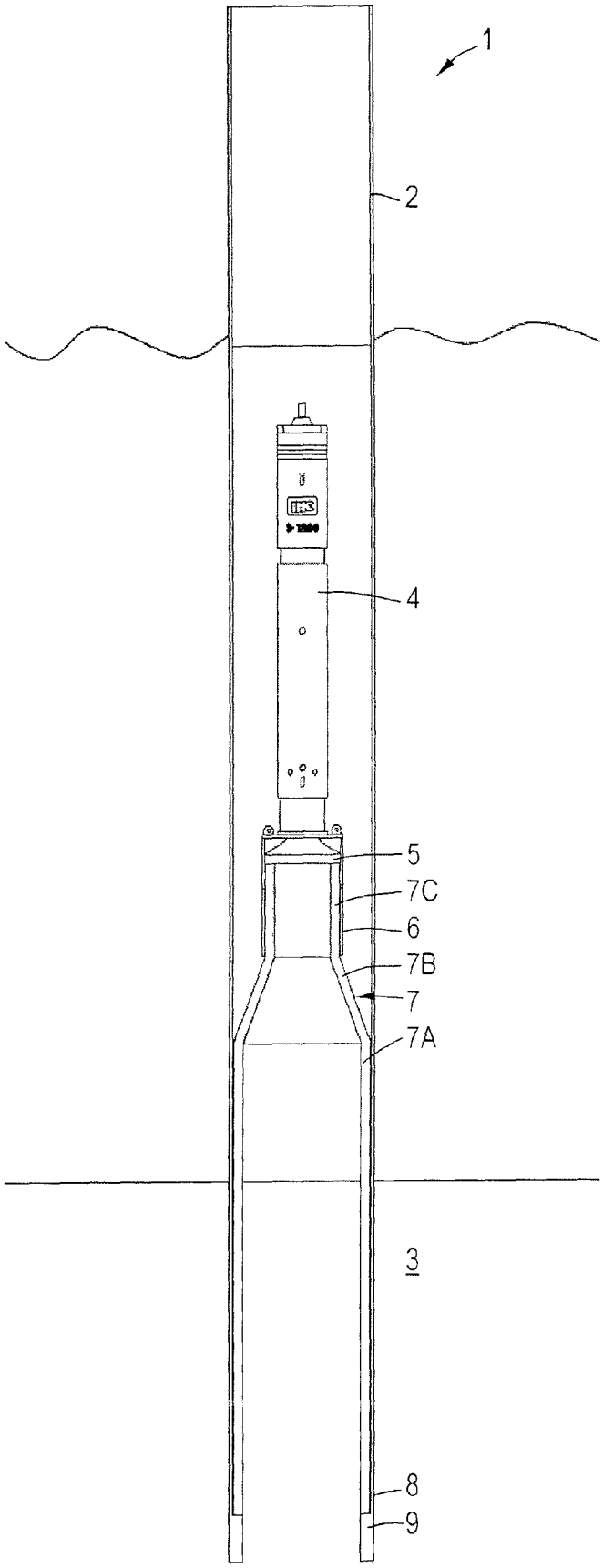
1
2
4
5
7C
6
7B
7
7A
3
8
9

SYSTEM FOR AND METHOD OF INSTALLING FOUNDATION ELEMENTS IN AN UNDERWATER GROUND FORMATION

PRIORITY CLAIM TO RELATED APPLICATIONS

This application is a national stage application under 35 U.S.C. §371 of PCT/EP2010/065355, filed Oct. 13, 2010, published as WO 2011/045345A1 on Apr. 21, 2011, and claiming priority to European Application No. 09173272.7, filed Oct. 16, 2009, which International and European applications and publications are incorporated herein by reference and made a part hereof in its entirety, and the benefit of priority of which is claimed herein.

The invention relates to a system for and a method of installing foundation elements, in particular (mono)piles, in an underwater ground formation, which system comprises a hydraulic driver and an anvil. The invention further relates to an adaptor for use in such a system as well as to a method of installing foundation elements in an underwater ground formation.

As explained in European patent publication 1 989 358 (which corresponds to German application DE 10 2006 008 095), offshore ramming work is carried out under water to establish foundations, for example, for drilling platforms and wind turbines. For wind turbines, large monopiles with a diameter of more than four meters are rammed into the seabed. This ramming results in a substantial underwater noise input, which can have a negative impact on marine fauna.

To reduce the noise input underwater, in the method and device according to EP 1 989 358, the material that is to be rammed is surrounded by a fixed flooded sleeve. The sleeve advantageously has a sandwich-like structure.

It is an object of the present invention to provide a system which reduces noise input through relatively compact means and which preferably allows use of existing drivers, such as IHC S or SC class hydraulic hammers, and anvils i.e. without imposing significant alterations on these tools.

To this end, the system according to the present invention comprises an adaptor for transmitting energy from the anvil to the toe of the foundation element, which adaptor fits inside the tubular foundation element.

Thus, the pressure waves in the pile resulting from driving are strongest at or near the toe of the pile and, once the toe of the pile has penetrated the soil, will be partially absorbed by the soil before reaching surrounding water. The lower end of the adaptor can be tailored to the toe of the pile, whereas the upper end of the adaptor can be tailored to the anvil and the driver used.

To limit the effect of the adaptor on the projected area or 'footprint' of the assembly of the foundation element and the adaptor, it is preferred that the latter comprises a tubular lower section, which is open at least its bottom and which, once the adaptor is positioned inside the foundation element, extends parallel to the element. In an embodiment, the cross-section of the lower section of the adaptor corresponds in shape to the cross-section of the foundation element, e.g. both said lower section of the adaptor and the foundation element are cylindrical and have a circular cross-section.

In a preferred embodiment, the inner wall of the foundation element is provided at or near its toe with a support for the adaptor, which support serves as a so-called drive shoe. In a more specific embodiment, the support comprises a shoulder protruding from the inner wall of the foundation element, e.g., a ring integral with or welded to the inner wall of the foundation element. With respect to the position of the support, the wording 'near the toe' is defined as a distance from the toe that is smaller than 25% of the length of the foundation element, preferably smaller than 10% and/or smaller than 5 meters.

In a further embodiment, the inner diameter of the adaptor, where it rests on the support, differs from the inner diameter of the support, providing a step in the inner wall of the 61 assembly, preferably a step in a range from 0.5 to 2 centimeters and preferably over the whole circumference of the support. Such overcutting reduces friction during driving between the assembly and the soil.

The invention further relates to a method of installing tubular foundation elements having open ends, in particular (mono)piles, in an underwater ground formation, by means of a hydraulic driver, and characterised by placing an adaptor inside the tubular foundation element, preferably on a support on the inner wall of the foundation element , t or near its toe, placing an anvil on top of the adaptor, placing the hydraulic driver on top of the anvil, and driving the foundation element into the ground formation by transmitting energy from the anvil through the adaptor to the toe of the foundation element.

Thus, as explained above, the pressure waves in the pile resulting from driving will be partially absorbed by the soil before reaching surrounding water.

The adaptor preferably comprises a tubular lower section, which, once the adaptor is positioned inside the foundation element, extends parallel to the element.

The foundation element itself can be used as a means to reduce noise input. To this end, it is preferred that the anvil is located inside the foundation element and/or that water is removed from the foundation element such that the anvil is separated from the inner wall of the foundation element by air, at least during part of driving. In an embodiment, a plurality of tubular foundation elements is installed in succession by means of the same adaptor.

For the sake of completeness, attention is drawn to the following prior art.

U.S. Pat. No. 3,824,797 discloses driving long piles into submerged lands with a liquid ram or spear generated in an evacuated tube. When the pile is of sufficient length and diameter, and also to facilitate the handling of long assemblies, the hammer tube (numeral 4 in FIGS. 2 and 3 of U.S. Pat. No. 3,824,797) may be located internally within the pile using any internal coupling (e.g. the coupling indicated by numeral 40). This permits incremental upward repositioning of the hammer as the pile (1) is driven into the bottom (100). It also permits coupling of the driver to the pile at a position which is closer to the sub-soil (100) than the top of the pile, giving an improved driving action.

EP 1 482 094 relates to the manufacture of foundation piles by forcing a retractable tube into the ground, which tube is then filled with a curable material, for instance concrete, optionally provided with a reinforcement. With retraction of the tube, the partially cured material with the reinforcement remains in the ground and, after curing, forms a foundation pile which supports on a bearing layer in the ground. The tube is provided with a replaceable mouthpiece on the bottom end of the tube, which mouthpiece is closed by means of a lost end flange.

GB 561,765 relates to a hollow interlocking pile intended to be driven by means of a pile hammer driving on top of the pile or internally at the bottom. The pile is formed as a continuous wall affording a hollow cylinder open at both ends and is provided with external longitudinal members for laterally interlocking with those of adjacent piles.

WO 2006/117380 pertains to a system for installing foundation elements in a sub-sea ground formation, comprising a hydraulic driver and a power converter for generating hydraulic pressure in a hydraulic fluid for the driver. The driver and the converter are adapted to fit inside the foundation elements.

GB 2 089 407 relates to a submersible ramming apparatus. JP 60 159218 relates to "a method wherein a surrounding part, which is formed by a resilient material and formed in the shape of bellows, is located around a pile, a space between the pile and the surrounding part is filled with liquid, and gas is mixedly present in the liquid." DE 1 784 396 discloses a pile driver comprising a telescopic sound absorbing sleeve.

The invention will now be explained in more detail with reference to the FIGURE, which shows a preferred embodiment of the present system. It is noted that the FIGURE is schematic in nature and that details, which are not necessary for understanding the present invention, may have been omitted.

The FIGURE shows an embodiment of the system 1 according to the present invention for installing a monopile 2 in an underwater ground formation 3. In this example, the monopile 2 has a circular cross-section and a diameter of four (4) meters and is intended to serve, after installation, as the foundation of a windmill.

In addition to the pile 2, the system 1 comprises an hydraulic driver 4, e.g. an IHC Hydrohammer S-1800, connected to a power pack on board of a surface vessel (not shown), an anvil 5, a sleeve 6, and an adaptor 7 for transmitting energy from the anvil 5 to the toe 8 of the pile 2. The pile is provided at its toe with an annular shoulder 9 protruding from its inner wall, which shoulder supports the adaptor and serves as a so-called drive shoe. In this example, the shoulder is an integral part of the toe of the pile.

The adaptor 7 comprises a tubular lower section 7A, which fits closely in the pile 2. In general, to enable, on the one hand, expedient positioning of the adaptor inside the pile and, on the other hand, sufficient contact between the adaptor and the support, it is preferred that the outer diameter of the tubular section of the adaptor is in a range from 1 to 5 cm smaller than the inner diameter of the pile.

The adaptor further comprises a frusto-conical transitional section 7B, which converges from the diameter of the lower tubular section 7A to a diameter slightly smaller than that of the anvil 5 and the sleeve 6, and an tubular upper section 7C for carrying the anvil 5 and for mounting the sleeve 6 on the adaptor 7. To provide a transition that is both sufficiently strong and not disproportionally long, it is generally preferred that the slope of the transitional section (7B) is in a range from 1:5 to 1:15 (width in radial direction : length in axial direction). The outer wall of the adaptor 7 is provided with an anti-rumbling material, e.g. coated with an anti-rumbling bitumen paste.

During pile driving, the blow energy of the driver is distributed by the anvil over the circumference of the upper section of the adaptor and transmitted through the adaptor to the toe of the pile. With each blow, the toes of the pile and the anvil are forced deeper into the soil and the pile is pulled into the soil. Thus, the pressure waves resulting from driving are strongest at or near the toe of the pile and, once the toe of the pile has penetrated the soil, will be partially absorbed by the soil before reaching surrounding water.

The invention is not restricted to the embodiment described above and can be varied in numerous ways within the scope of the claims. Although the system according to the present invention is especially advantageous for installing (mono) piles having a diameter sufficiently large to accommodate the driver as well, it can also be used with tubular foundation elements having a smaller diameter. In principle, the inner diameter of the foundation element can be smaller than the effective diameter of the driver. In that case, the diameter of the lower section of the adaptor is smaller than that of the driver and optionally comprises a transitional section which diverges upward.

The invention claimed is:

1. A system for installing tubular foundation elements having open ends, in an underwater ground formation, comprising:

a. An hydraulic driver, b. An anvil, and c. An adaptor for transmitting energy from the anvil to the toe of the tubular foundation element, wherein:

i. The adaptor fits inside the tubular foundation element, ii. The adaptor comprises a tubular lower section, which is open at at least its bottom and the tubular lower section extends parallel to the tubular foundation element when the adaptor is positioned inside the tubular foundation element, iii. The inner wall of the tubular foundation element at or near the toe of the tubular foundation element is provided with a support for the adaptor.

2. The system according to claim 1, wherein the cross-section of the tubular lower section of the adaptor corresponds in shape to the cross-section of the tubular foundation element.

3. The system according to claim 1, wherein the support comprises a shoulder protruding from the inner wall of the tubular foundation element.

4. The system according to claim 1, wherein the inner diameter of the adaptor where the adaptor rests on the support differs from the inner diameter of the support, providing a step in the inner wall of the tubular foundation element.

5. The system according to claim 1, wherein the tubular foundation elements are piles.

6. The system according to claim 1, wherein the adaptor comprises a transitional section, wherein said transitional section converges from the dimensions of the tubular lower section to dimensions corresponding to the dimensions of the anvil.

7. The system according to claim 6, wherein the slope of the transitional section is in a range from 1:5 to 1:15.

8. The system according to claim 1, wherein at least part of the outer wall of the adaptor is provided with an anti-rumbling material.

9. An adaptor suitable for use in a system for installing tubular foundation elements having open ends in an underwater ground formation, said system comprising:

a. A hydraulic driver and an anvil, wherein:

b. Said adaptor is configured to transmit energy from the anvil to the toe of the tubuar foundation element and fits inside the tubular foundation element, c. Wherein said adaptor comprises a tubular lower section to be supported by the inner wall of the tubular foundation element, d. Wherein said tubular lower section is open at at least its bottom and the tubular lower section extends parallel to the tubular foundation element when the adaptor is positioned inside the tubular foundation element, the inner wall of the tubular foundation element at or near the toe of the tubular foundation element is provided with a support for the adaptor.

10. The adaptor according to claim 9, wherein the adaptor comprises a transitional section, wherein said transitional section converges from the dimensions of the tubular lower section to dimensions corresponding to the dimensions of the anvil.

11. The adaptor according to claim 10, wherein the slope of the transitional section is in a range from 1:5 to 1:15.

12. The adaptor according to claim 9, wherein at least part of the outer wall of the adaptor is provided with an anti-rumbling material.

13. A method for installing tubular foundation elements having open ends in an underwater ground formation using a hydraulic driver, said method comprising:

a. Placing an adaptor inside the tubular foundation element, b. Coupling the adaptor to the inner wall of the tubular foundation element at or near its toe, c. Placing an anvil on top of the adaptor, d. Placing the hydraulic driver on top of the anvil, and e. Driving the tubular foundation element into the ground formation by transmitting energy from the anvil through the adaptor to the toe of the tubular foundation element, wherein:

i. The adaptor comprises a tubular lower section, which is open at at least its bottom and the tubular lower section extends parallel to the tubular foundation element when the adaptor is placed inside the tubuar foundation element, ii. The inner wall of the tubular foundation element at or near the toe of the tubular foundation element is provided with a support for the adaptor.

14. The method according to claim 13, wherein the anvil is located inside the tubular foundation element.

15. The method according to claim 14, wherein water is removed from the tubular foundation element such that the anvil is separated from the inner wall of the tubular foundation element by air, at least during part of driving.

16. The method according to claim 14, wherein the toe of the tubular foundation element is in the ground, at least during part of driving.

17. The method according to claim 13, wherein a plurality of tubular foundation elements is installed in succession by using the same adaptor.

* * * * *